US006076556A

United States Patent [19]

Fuchs et al.

[11] Patent Number: 6,076,556

[45] Date of Patent: Jun. 20, 2000

[54] CONNECTION DEVICE FOR A HYDRAULIC CONTROL UNIT MADE OF LIGHT METAL

[75] Inventors: Robert Fuchs, Wiernsheim; Edmund Sander; Michael Funk, both of Leonberg, all of Germany

[73] Assignee: Dr. Ing. h.c.F. Porsche AG, Weissach, Germany

[21] Appl. No.: 09/210,758

[22] Filed: Dec. 15, 1998

[30] Foreign Application Priority Data

Dec. 24, 1997 [DE] Germany ..... 197 57 865

[51] Int. Cl.[7] ..... F15B 21/00

[52] U.S. Cl. ..... 137/884

[58] Field of Search ..... 137/315, 884

[56] References Cited

U.S. PATENT DOCUMENTS

| | | | |
|---|---|---|---|
| 3,025,878 | 3/1962 | Hupp | 137/884 X |
| 3,213,883 | 10/1965 | Carls | 137/884 |
| 3,391,703 | 7/1968 | Kay | 137/884 X |
| 3,661,166 | 5/1972 | Dickason | 137/884 X |
| 3,760,844 | 9/1973 | Olson et al. | 137/884 |
| 4,449,426 | 5/1984 | Younger | 137/884 X |
| 4,507,707 | 3/1985 | Willis | 137/884 X |
| 4,509,556 | 4/1985 | Scanlon | 137/884 |
| 5,086,803 | 2/1992 | Nakajima | 137/884 X |
| 5,094,143 | 3/1992 | Andersen, Jr. | 137/884 X |
| 5,459,953 | 10/1995 | Fukano et al. | 137/884 X |
| 5,725,255 | 3/1998 | Hayashi et al. | 137/884 X |

FOREIGN PATENT DOCUMENTS

| | | |
|---|---|---|
| 0728970A2 | 8/1996 | European Pat. Off. . |
| 0797008A2 | 9/1997 | European Pat. Off. . |
| 0803654A2 | 10/1997 | European Pat. Off. . |
| 0813009A1 | 12/1997 | European Pat. Off. . |

OTHER PUBLICATIONS

European Search Report, Jul. 27, 1999.

*Primary Examiner*—John Rivell

*Attorney, Agent, or Firm*—Evenson, McKeown, Edwards & Lenahan, P.L.L.C.

[57] ABSTRACT

A hydraulic control unit is provided which has a housing made of a light metal and connection devices for the connection with hydraulic conduits. In order to reduce the danger of damage to the housing in the area of the connection devices, a plate made of steel for accommodating the connection devices is held on a flange surface of the housing.

17 Claims, 2 Drawing Sheets

CONNECTION DEVICE FOR A HYDRAULIC CONTROL UNIT MADE OF LIGHT METAL

BACKGROUND AND SUMMARY OF THE INVENTION

This application claims the priority of German application 197 57 865.9, filed in Germany on Dec. 24, 1997, the disclosure of which is expressly incorporated by reference herein.

The invention relates to a hydraulic control unit having a housing made of light metal and connection devices for a connection with hydraulic conduits.

Hydraulic control units consist of a housing on which additional hydraulic devices, such as valves, filters, etc. are held. The housing has the task of guiding the flows of the hydraulic fluid; for this purpose, conduits in the form of grooves are provided in the housing. For the connection with the device to be controlled, such as a vehicle transmission, it is usually provided that the control unit is placed directly on the device to be controlled and the hydraulic connection is established by corresponding openings in a flange surface. Usually, beyond these internal connections, external connections are provided, as, for example, for the supply with hydraulic fluid and outflows to external hydraulic apparatuses which are also to be acted upon by the control unit.

For reasons of weight and for an easier manufacture and machining, the housings for such control units are usually made of a light metal. The problem arises in the area of the external connection devices that during the mounting of the external connections comparatively high forces, such as tightening moments in the case of screwed connections, must be applied in order to securely seal off the connection with respect to the hydraulic pressure. However, specifically in light-metal housings, the forces at which the housing is damaged, for example, by the tearing of a thread, are only slightly above the forces required for the sealing. In particular, the forces resulting in damage can easily be applied manually. Such damage will then also result in damage to the very expensive housing of the control unit and the housing must be repaired or replaced at high expenditures.

In view of this state of the art, it is an object of the invention to reduce the danger of damage to the housing in the area of the connection devices.

According to the invention, this object is achieved by providing a steel plate held on a flange surface of the control unit, which steel plate accommodates the connection devices. It is suggested that a plate made of steel be provided for receiving the connection devices, which plate is held on a flange surface of the housing. In contrast to the housing made of light metal, the steel plate is significantly less sensitive to damage because the forces necessary to result in damage are much higher. Should damage nevertheless occur during the mounting of the connection devices, the steel plate must only be exchanged, while the control unit itself must not even be demounted so that this exchange can take place particularly rapidly and at low cost.

It is suggested that in the plate for receiving the connection devices, bores with threads be provided which correspond to conduit bores of the housing arranged in the flange surface. In this application, the advantages of the invention are particularly noticeable since, especially in the case of a screwed connection in the area of the connection devices, the danger of damage caused by an excessive tightening moment is particularly high.

It is also suggested to provide a seal between the steel plate and the flange surface in order to avoid a flowing-out of hydraulic fluid in the area of the flange surface. Such a seal may, for example, be constructed as a shaped seal inserted into the steel plate, as a flat seal placed onto the plate or in the form of inserted O-rings in the area of the conduit bores.

If the conduit bores are to accommodate insert valves in the flange surface, it is also provided that the plate simultaneously forms the abutment for these valves. Such an abutment will for example, be required when the valve insert is constructed as a prestressed return valve and therefore a spring arranged on the return valve must be supported for applying the prestressing force.

Finally, it is suggested to provide projections laterally on the plate which rest on lateral surfaces of the flange surface. By means of this shaping of the plate, the torques introduced into the plate during the mounting of the connection devices can be supported in a form-locking manner so that this stress must not be absorbed by the fastening devices of the plate. A preferred application field of the invention are hydraulically actuated vehicle transmissions.

Other objects, advantages and novel features of the present invention will become apparent from the following detailed description of the invention when considered in conjunction with the accompanying drawings.

DETAILED DESCRIPTION OF THE DRAWINGS

Figure 1:
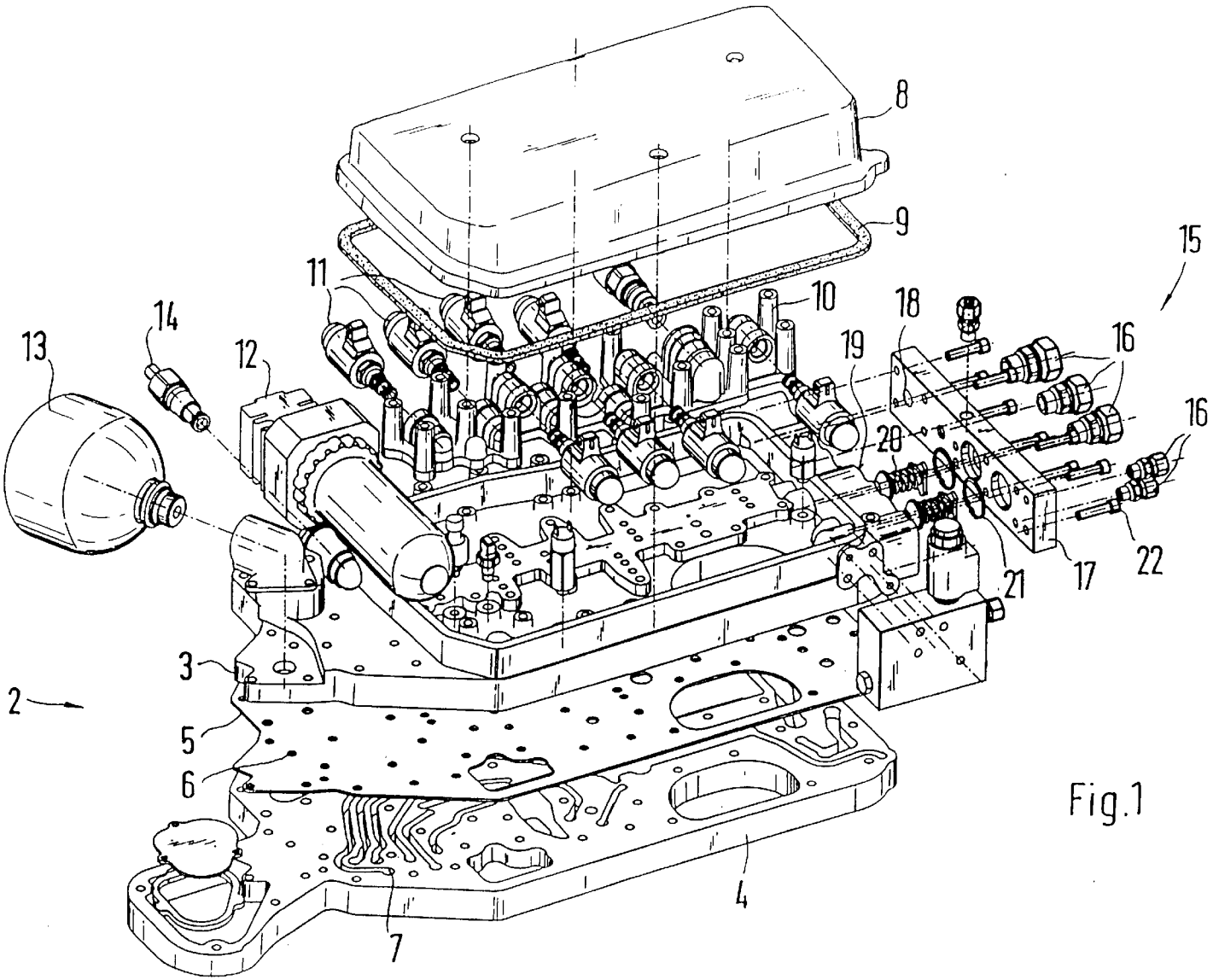
FIG. 1 is an exploded representation of a hydraulic control unit constructed according to a preferred embodiment of the invention.

FIG. 1 is an exploded view of a hydraulic control unit 1. A housing 2 manufactured of light metal consists of a top part 3, and a bottom part 4, with a sealing plate inserted in-between. In preferred embodiments the light metal is aluminum or another light metal/metal alloy which is substantially lighter and softer than steel. The sealing plate 5 has a plurality of bores 6 which are used for connecting grooves 7 and which are provided in the top part 3 as well as in the bottom part 4. For covering the housing 2, a cover 8 is provided which has a seal inserted on the edge side.

On the top part 2 and covered by the cover 8, a valve strip 10 is arranged which carries a plurality of electrically actuated valves 11. In addition, various elements of the hydraulic pressure supply are arranged on the top side 3, such as a filter 12 for the hydraulic fluid, a pressure accumulator 13 as well as a pressure limiting valve 14.

For the connection with external hydraulic devices, connection devices 15 are provided in the form of threaded connection ends 16 which are connected with the hydraulic conduits in a manner not shown in detail. For accommodating the connection devices 15, a steel plate 17 is provided which is screwed to the housing 2 by means of screws 22. Threaded bores 18 for receiving the threaded connection ends 16 are machined into the steel plate 17.

Figure 2:
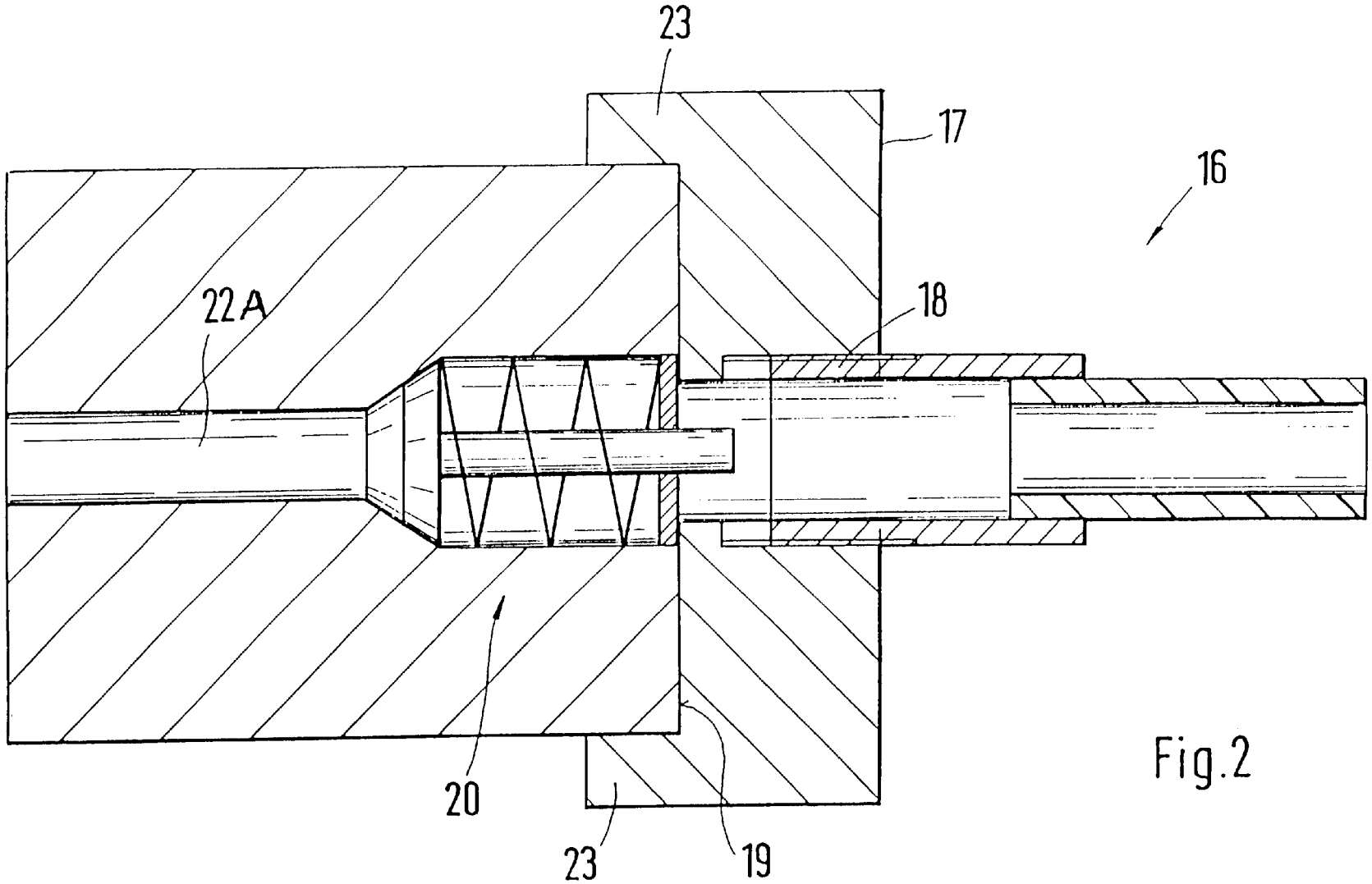
FIG. 2 is a sectional view of a connection device for use with the control unit of FIG. 1.

A flange surface section 19 for receiving the steel plate 17 is provided on the housing 2, in which flange surface section 19 conduit bores 22A are provided which correspond to the threaded bores 18. Two of these conduit bores 22A receive valve inserts 20 which are constructed as return valves in the embodiment shown. In order to apply the prestressing force required for operating the valve inserts 20, these are prestressed in the conduit bores by means of steps, which are not shown, as well as retaining rings 21. As illustrated in FIG. 2, it is, however, conceivable to eliminate the retaining rings 21 and to apply the prestressing force by the steel plate 17 in the mounted condition.

In addition, the steel plate 17 may be equipped with lateral projections 23 which reach laterally around the flange surface 19 and therefore provide a correct fit of the steel plate 17 also in the event that large torques must be supported when the threaded connection pieces 16 are mounted.

In the present case, the control unit 1 is used for controlling an automatic vehicle transmission and is flanged for this purpose directly by means of its bottom part 4 to the automatic transmission, which is not shown.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. Hydraulic control unit having a housing made of light metal and connection devices for the connection with hydraulic conduits, wherein a plate made of steel is provided for accommodating the connection devices, this plate being held on a flange surface of the control unit.

2. Hydraulic control unit according to claim 1, wherein bores with a thread are provided in the plate for receiving the connection devices, which bores are arranged corresponding to and aligned with conduit bores in the flange surface.

3. Hydraulic control unit according to claim 1, wherein a seal is provided between the plate and the flange surface.

4. Hydraulic control unit according to claim 2, wherein a seal is provided between the plate and the flange surface.

5. Hydraulic control unit according to claim 1, wherein the plate simultaneously forms the abutment for valves which are held in conduit bores in the flange surface.

6. Hydraulic control unit according to claim 2, wherein the plate simultaneously forms the abutment for valves which are held in conduit bores in the flange surface.

7. Hydraulic control unit according to claim 3, wherein the plate simultaneously forms the abutment for valves which are held in conduit bores in the flange surface.

8. Hydraulic control unit according to claim 4, wherein the plate simultaneously forms the abutment for valves which are held in conduit bores in the flange surface.

9. Hydraulic control unit according to claim 1, wherein the plate has lateral projections which rest against lateral surfaces of the flange surface.

10. Hydraulic control unit according to claim 2, wherein the plate has lateral projections which rest against lateral surfaces of the flange surface.

11. Hydraulic control unit according to claim 3, wherein the plate has lateral projections which rest against lateral surfaces of the flange surface.

12. Hydraulic control unit according to claim 4, wherein the plate has lateral projections which rest against lateral surfaces of the flange surface.

13. Hydraulic control unit according to claim 5, wherein the plate has lateral projections which rest against lateral surfaces of the flange surface.

14. Hydraulic control unit according to claim 6, wherein the plate has lateral projections which rest against lateral surfaces of the flange surface.

15. Hydraulic control unit according to claim 7, wherein the plate has lateral projections which rest against lateral surfaces of the flange surface.

16. Hydraulic control unit according to claim 8, wherein the plate has lateral projections which rest against lateral surfaces of the flange surface.

17. Hydraulic control unit according to claim 1, wherein said hydraulic control unit includes transmission control valves for a vehicle transmission.

* * * * *